US006234843B1

(12) United States Patent
Pavlovic

(10) Patent No.: US 6,234,843 B1
(45) Date of Patent: May 22, 2001

(54) LOW PROFILE FILTER CONNECTOR WITH FERRITE

(75) Inventor: Slobodan Pavlovic, Canton, MI (US)

(73) Assignee: Framatome Connectors Interlock Inc., Westland, MI (US)

( * ) Notice: Subject to any disclaimer, the term of this patent is extended or adjusted under 35 U.S.C. 154(b) by 0 days.

(21) Appl. No.: 09/206,142

(22) Filed: Dec. 7, 1998

(51) Int. Cl.[7] ..... H01R 13/66
(52) U.S. Cl. ..... 439/620
(58) Field of Search ..... 439/620; 333/181–185

(56) References Cited

U.S. PATENT DOCUMENTS 5,200,574 4/1993 Cunningham et al. ..... 102/530
5,213,522 5/1993 Kojima ..... 439/620
5,241,910 9/1993 Cunningham et al. ..... 102/530
5,489,220 2/1996 Hanna et al. ..... 439/620
5,586,902 12/1996 Hopf et al. ..... 439/352

*Primary Examiner*—Gary F. Paumen
(74) *Attorney, Agent, or Firm*—Perman & Green, LLP

(57) ABSTRACT

An electrical connector having a housing, electrical contacts and a ferrite block. The contacts have two connection areas and a lead section between the two connection areas. The lead section has a flat shape. The ferrite block is mounted on the lead sections. The ferrite block has low profile cross-sectionally rectangular slots therethrough which the lead sections pass through such that the ferrite block has a reduced height to provide a reduced height low profile filter connector.

18 Claims, 4 Drawing Sheets

FIG.2B
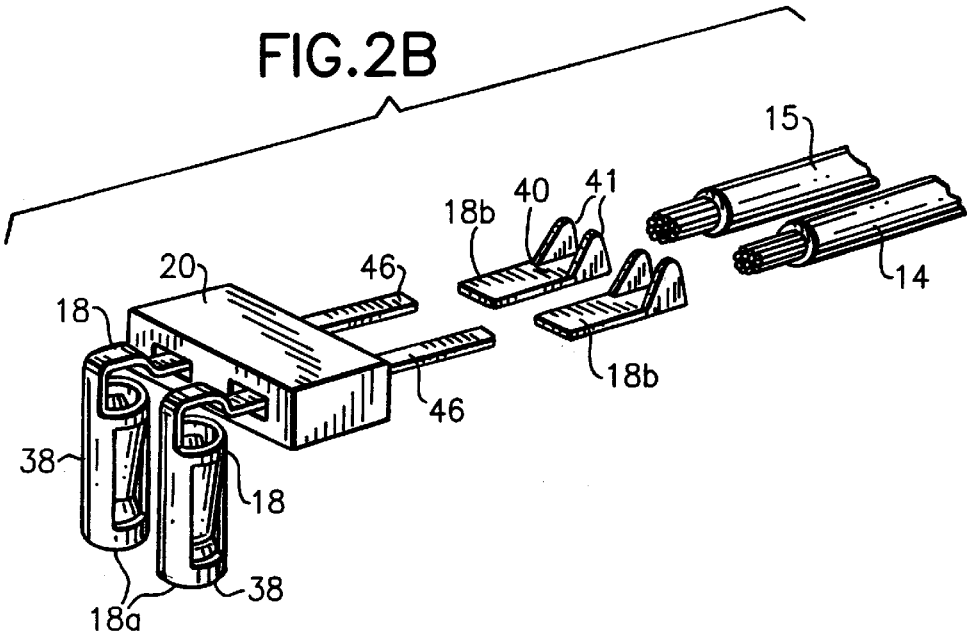
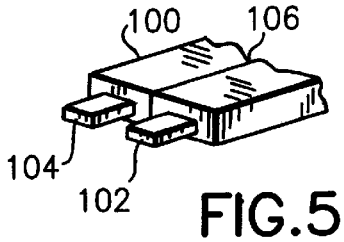
FIG.5
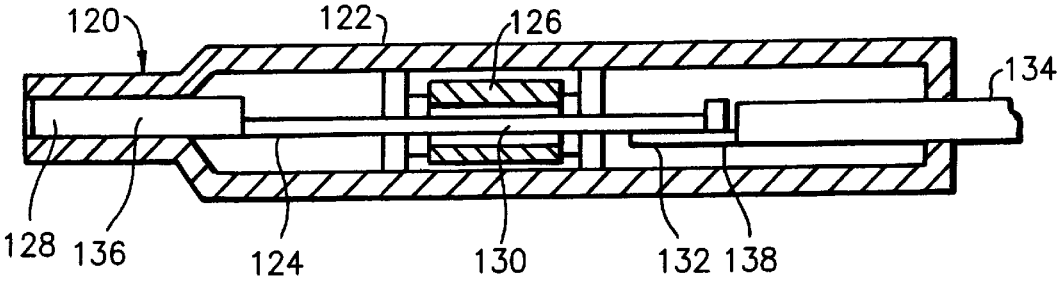
FIG.6

LOW PROFILE FILTER CONNECTOR WITH FERRITE

BACKGROUND OF THE INVENTION

1. Field of the Invention

The present invention relates to electrical connectors and, more particularly, to a filter connector having a ferrite block.

2. Prior Art

U.S. Pat. No. 5,489,220 discloses a filter connector having a ferrite barrel with rectangular bores. U.S. Pat. No. 5,213,522 discloses a filter connector with ferrite blocks surrounding portions of connector pins between the pins' two connection ends. U.S. Pat. No. 5,586,902 discloses a filter connector with a ferrite block spaced from the connector's contacts and located on conductor cables extending into the connector.

SUMMARY OF THE INVENTION

In accordance with one embodiment of the present invention an electrical connector is provided comprising a housing, electrical contacts connected to the housing, and a ferrite block connected to the housing. The contacts each have a first connection area for electrical connection to a mating contact and a second connection area for connection to an electrical conductor. The ferrite block surrounds a portion of at least one of the electrical contacts at a location between the first and second connection areas.

In accordance with another embodiment of the present invention an electrical connector is provided comprising a housing and electrical contacts connected to the housing. The electrical contacts each comprise a first female connection area for receiving a male contact and a lead extending from the first connection area at an angle of about 90°. The leads have flat side profiles. The connector further comprises at least one ferrite block surrounding the leads.

In accordance with another embodiment of the present invention an electrical connector is provided comprising a housing, electrical contacts connected to the housing, and a ferrite block. The ferrite block surrounds portions of the electrical contacts. The ferrite block has two slots extending through the block. Each slot has a height less than a width of the slot.

BRIEF DESCRIPTION OF THE DRAWINGS

The foregoing aspects and other features of the present invention are explained in the following description, taken in connection with the accompanying drawings, wherein:

FIG. 2B is an exploded perspective view of the contacts, ferrite block and conductors used with the connector shown in FIG. 1;

FIG. 5 is a perspective view of an end of a flat conductor cable used with the connector shown in FIG. 3; and FIG. 6 is a cross-sectional view of an alternate embodiment of the electrical connector.

DETAILED DESCRIPTION OF THE PREFERRED EMBODIMENT

Figure 1:
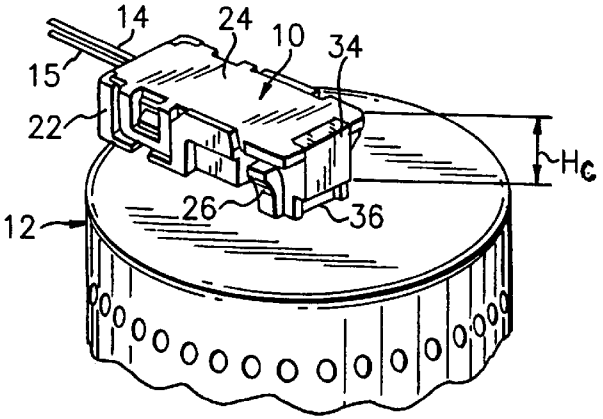
FIG. 1 is a perspective view of an electrical connector incorporating features of the present invention connected to an air bag gas generator.

Referring to FIG. 1, there is shown a perspective view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 3:
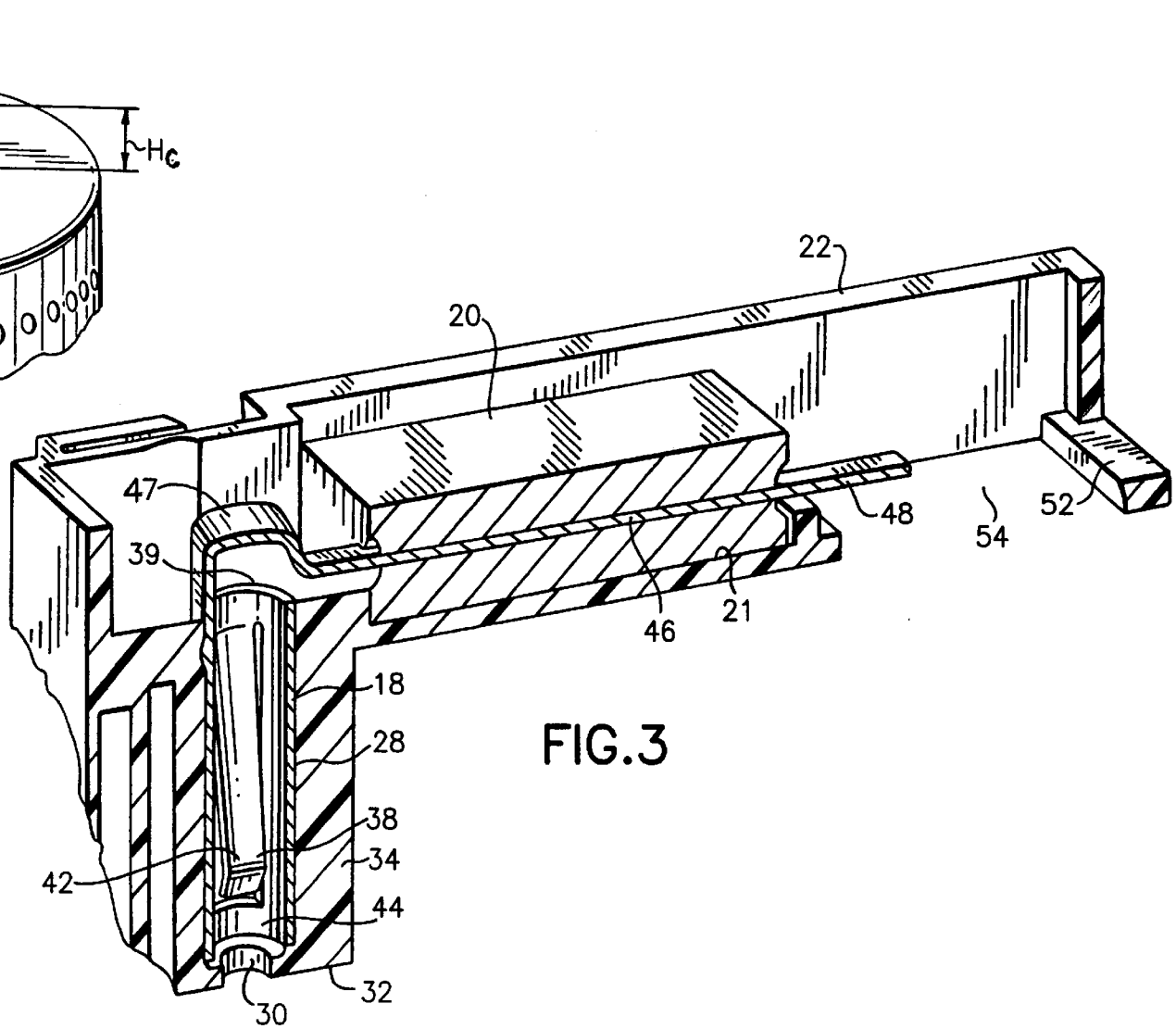
FIG. 3 is a partial cross-sectional view of the connector shown in FIG. 1 without the intermediate crimp members.
Figure 2A:
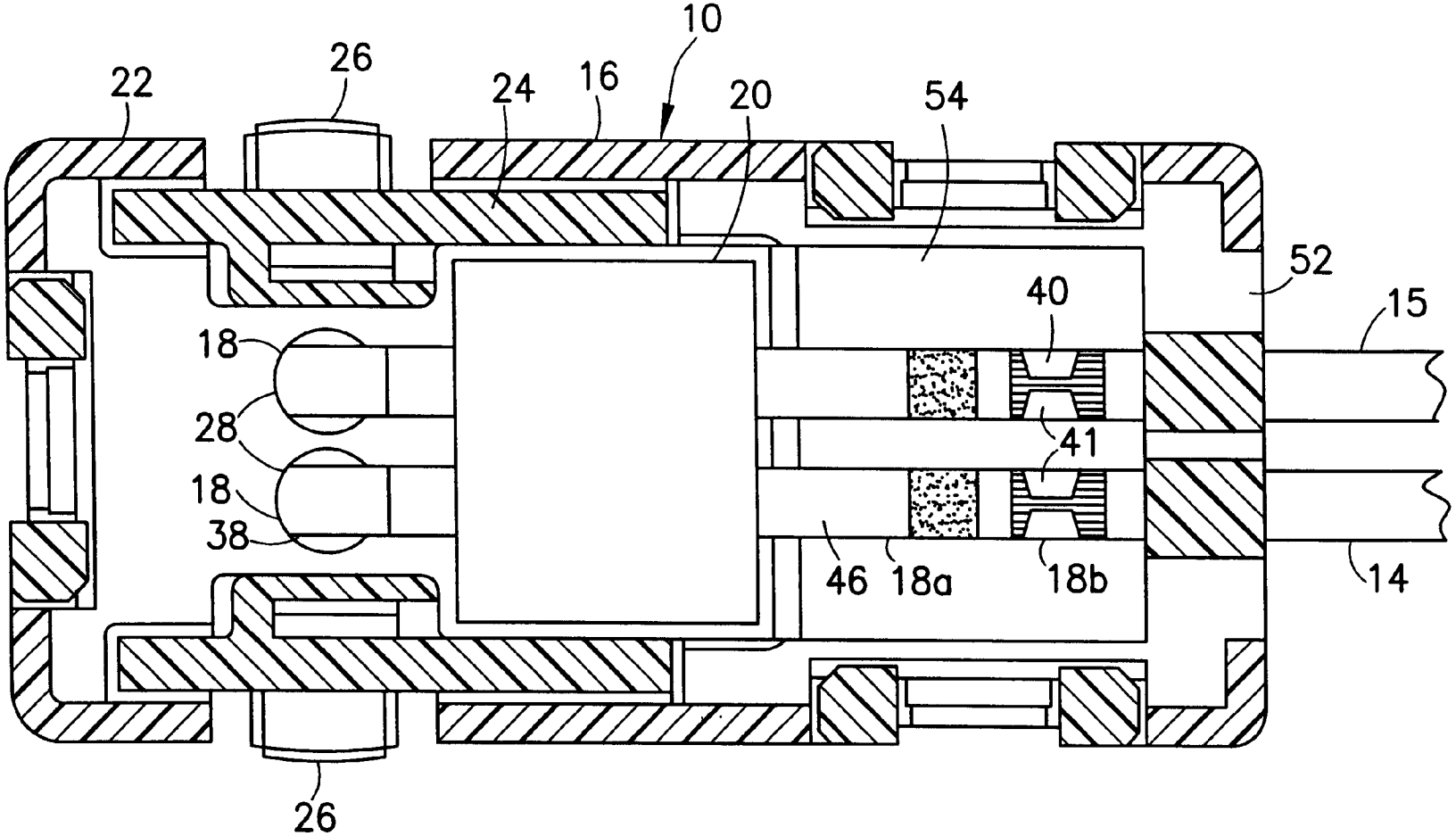
FIG. 2A is a cross-sectional view of the connector shown in FIG. 1.

The connector 10, in this embodiment, is for use in connecting electrical conductors 14, 15 with an air bag gas generator 12. However, the connector 10 could be used to connect conductors with other devices. Referring also to FIGS. 2A, 2B, 3 the connector 10 generally comprises a housing 16, electrical contacts 18 and a ferrite block or hood 20. The housing 16 comprises a first housing piece 22 and a second housing piece 24. The first housing piece 22 includes two cantilevered finger actuatable deflectable latches 26, two separate receiving areas 28, and two holes 30 through a bottom face 32 of the housing into the receiving areas 28. The housing 16, at the bottom of the front section 34, is adapted to be plugged into a socket 36 of the gas generator 12. The latches 26 are adapted to latch with the latch surfaces in the socket 36. Preferably, additional connector position assurance means is provided to prevent the connector 10 from accidentally being disengaged from the gas generator 12. The second housing piece 24 is connected to the first housing piece 22 after the contacts 18 and ferrite hood 20 are located in the first housing piece 22. However, in alternate embodiments other types of housings or housing components could be provided. FIG. 3 shows the first housing piece 22 before the second housing piece is connected thereon. In an alternate embodiment the second housing piece could be molded onto the first housing piece. In this embodiment the first housing piece is provided with two holes 52, 54 in its rear end; hole 52 for providing a passageway for the conductors 14, 15 out the rear end, and hole 54 for access for a tool (not shown) to crimp the tabs 41 on the conductors 14, 15.

The electrical contacts 18 each comprise a female contact area 38 and a connection area 40 for connection to the electrical conductors 14, 15. Preferably, the contacts 18 are comprised of stamped and formed sheet metal. In the embodiment shown in FIGS. 2A and 2B the contacts each comprise a first member 18*a* and a second member 18*b*. The first member 18*a* is preferably a one-piece member which comprises the female contact area 38 and a lead section 46. However, the first member 18*a* could be provided as a multi-piece member. The second member 18*b* is preferably a one-piece member with tabs 41 that form a conductor connection area 40. The second member 18*b* is preferably stationarily attached to the end of the lead section 46, such as by welding, after the lead sections 46 are located in the ferrite block 20. The female contact area 38 has two spring contact arms 42 and a leading end positioner 44. The socket 36 has two male pin contacts (not shown) at a fixed spacing relative to each other that are received in the two female contact areas 38 through the holes 30 in the housing 12. The lead section 46 of each contact 18 extends between the female contact area 38 and the conductor connection area 40. In this embodiment the lead section 46 has a 90° bend for use in providing a right angle connector. However, the lead section could be straight for an in-line connector. In this embodiment the front end 47 of the lead section 46 has a hump shape to provide additional space for the top end 39 of the female contact area 38 to extend past the bottom of the ferrite block 20 and closer to the top of the housing 16. Thus, the length of the front plug section 34 can be reduced while still keeping the length of the female contact area 38 the same or even larger then in the prior art. This allows the engagement length with the male contacts to be kept the same or even increased. The lead section 46 has a flat side profile with a general cross-sectional rectangular shape along its length. This shape is easily provided if sheet metal is used to form the first member 18*a*, or at least used to form the lead section 46. The length of the lead section 46 is longer than the length of the ferrite block 20. The lead sections 46 extend through the ferrite block and have a tail section 48 that extend past the rear end of the ferrite block 20. The conductors 14, 15 could be crimped, soldered or welded to the connector areas 40. Thus, the contacts 18 are able to electrically connect the male pin contacts to the conductors 14, 15.

Figure 4A:
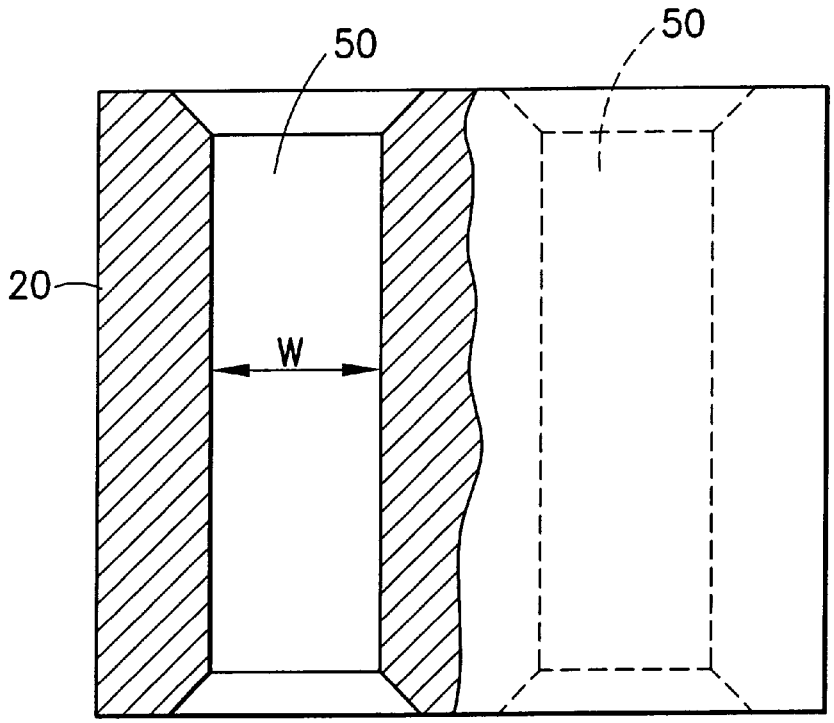
FIG. 4A is a top plan view with a cut-away section of the ferrite block shown in FIGS. 2A–3.
Figure 4B:
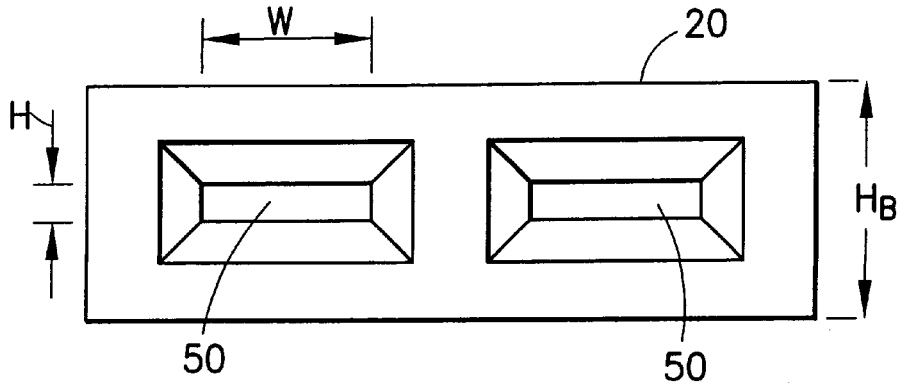
FIG. 4B is an elevational front view of the ferrite block shown in FIG. 4A.

Referring also to FIGS. 4A and 4B, the ferrite block 20 is shown. In an alternate embodiment the ferrite block 20 could be provided as separate spaced members on respective ones of the contacts 18. In this embodiment the ferrite block is comprised of electrically non-conductive ferrite oxide having a general rectangular box shape with two parallel side-by-side holes 50 passing therethrough from a front to a rear of the block The holes 50 have a general cross-sectionally rectangular shape along the length of the block with a height H being smaller than a width W. The cross-sectional shape of the holes 50 substantially match the cross-sectional shape of the lead sections 46. The two lead sections 46 extend through the holes 50. The second members 18*b* are then attached to the tail sections 48 after the block 20 is positioned on the lead sections. The tabs 41 of the second members 18*b* are then crimped onto the conductive cores of the conductors 14, 15. The assembly is then inserted into the first housing piece 22 with the female contact areas 38 received in the receiving areas 28 and the ferrite block 20 received in its receiving area 21 of the first housing piece 22. The second housing piece 24 is then connected to the first housing piece 22 to capture the assembly between the two housing pieces and provide strain relief for the conductors 14, 15. By providing the lead sections 46 with flat shapes, the height H of the holes 50 can be made small. Thus, the height $H_B$ of the block 20 can be reduced, compared to ferrite blocks used with non-flat shaped conductors, without reducing the effective working height of the ferrite material on top and beneath the lead section 46. With this reduction in the height $H_B$ of the ferrite block, the height $H_C$ which the connector extends past the end of the gas generator 12(see FIG. 1) can be reduced. Hence, a smaller height low profile filter connector can be provided. For example, in a prior art connector, such as in U.S. Pat. No. 5,586,902, the holes in the ferrite block would be about 2.6 mm high and the length of the ferrite block would be about 8.4 mm with a connector height of about 5.3 mm. With the present invention a same frequency attenuation can be provided with flat 0.25 mm high leads which are about 12 mm long to provide a connector height $H_C$ of about 2.6 mm. Thus, the connector height can be reduced in half. This can be of great advantage to allow the connector 10 to be used for both a front air bag or a side air bag in the small width of a car door, or even a seat belt air bag. Thus, different types of connectors do not need to be used in different applications; a universal right angle connector for use with all types of air bag gas generators can be provided. A unique advantage of the present invention relates to the relative positioning of the ferrite block 20 on the contacts 18. The ferrite block 20 is located on the lead sections 46 between the two connection areas 38, 40. Even if tabs 41 form antennas, because the connection area 40 is located behind the ferrite block 20, the block 20 can attenuate high frequency signals that might come from the tabs 41 before the signals reach the connection areas 38.

FIG. 5 shows a perspective view of an end of a flat conductor cable 100 which could be connected to the connector shown in FIG. 3 without use of the contact second members 18*b*. The cable 100 has conductors 102, 104 and electrical insulation 106. The spacing between the conductors 102, 104 and the spacing between the tail ends 48 of the contacts 18 would be the same. Thus, the ends of the conductors 102, 104 could merely be placed on the tail ends 48 and soldered onto the tail ends.

FIG. 6 is a cross-sectional view of an alternate embodiment of the connector. In this embodiment the connector 120 is a straight or in-line connector rather than a right angle connector. The connector 120 has a housing 122, contacts 124, and a ferrite block 126. The contacts 124 have a front female connection area 128, an integral lead 130 and a rear connection area 132. Conductors 134 pass through the rear end of the housing 122 and are crimped onto the rear connection area 132. The contacts have a first member 136 which forms the front connection area 128 and lead 130, and a second member 138. The second member is stationarily attached to the first member 136 and forms the rear connection area 132. The ferrite block 126 is located between and spaced from the two connection areas 128, 132. The connection areas 128, 132 and lead 130 are aligned in a straight row, one behind the other.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an electrical connector comprising a housing, electrical contacts connected to the housing, and a ferrite block located in the housing, the contacts each having a first connection area for electrical connection to a mating contact and a second connection area for connection to an electrical conductor, wherein the improvement comprises:

the ferrite block is a one-piece member surrounding a portion of at least one of the electrical contacts at a location between the first and second connection areas, wherein the portion of the at least one electrical contact has a flat shape, wherein the ferrite block comprises a flat rectangular channel, wherein the flat shaped portion is located in the flat rectangular channel, wherein the ferrite block is spaced from the first and second connection areas, wherein the ferrite block and the flat shaped portion extend away from the first connection area at a general right angle, wherein the at least one electrical contact comprises an area between the first connection area and the portion having a general hump shape forming a space for receiving an end of the first connection area, and wherein the end of the first connection area extends upward past a bottom of the ferrite block.

2. A connector as in claim 1 wherein the second connection area of the at least one electrical contact has a flat shape.

3. A connector as in claim 1 wherein the ferrite block has two of the channels therein arranged side-by-side and spaced from each other.

4. A connector as in claim 1 wherein a height of the channel is less than a width of the channel.

5. A connector as in claim 1 wherein the contacts comprise a first member and an intermediate second crimp member stationarily connected to the first member, the second member forming the second connection area.

6. An electrical connector as in claim 1 wherein the housing comprises a section with a height of the section being less than a width of the section, wherein the ferrite block is located in the section, and wherein the ferrite block comprises a height which is less than a width of the ferrite block.

7. An electrical connector as in claim 1 wherein the electrical contacts each comprise a lead between the first and second connection areas, and wherein the portion surrounded by the ferrite block comprises a majority of a length of the lead.

8. An electrical connector comprising:

a housing;

electrical contacts connected to the housing, the electrical contacts each comprising a first female connection area for removably receiving a male contact, and a lead extending from the first connection area at an angle of about 90°, wherein the leads have cross-sectionally flat shapes; and at least one ferrite block surrounding the leads, wherein the at least one ferrite block has two side-by-side channels therethrough, each channel having general cross-sectionally rectangular shapes along the length of the block with a height of each channel being smaller than a width of each channel, wherein the at least one ferrite block is spaced from the first connection areas of the contacts and is located between the first connection areas and conductor connection areas of the contacts at a general right angle to the first connection areas, wherein the lead comprises an area having a general hump shape forming a space for receiving an end of the first female connection area, and wherein the end of the first female connection area extends upward past a bottom of the at least one ferrite block.

9. A connector as in claim 8 wherein the conductor connection areas have a same shape as the leads.

10. A connector as in claim 8 wherein the leads are arranges side-by-side and spaced from each other with heights smaller than their widths.

11. An electrical connector as in claim 8 wherein the housing comprises a section with a height of the section being less than a width of the section, wherein the ferrite block is located in the section, and wherein the ferrite block comprises a height which is less than a width of the ferrite block.

12. An electrical connector as in claim 8 wherein portions of the leads surrounded by the ferrite block comprise a majority of a length of the leads.

13. An electrical connector comprising:

a housing having a first section and a second section generally perpendicular to the first section, the second section having a height less than a width of the second section and less than a height of the first section;

electrical contacts connected to the housing, the contacts each having a first female connection area inside the first section of the housing along a majority of a height of the first section of the housing; and a ferrite block located in the second section of the housing and surrounding portions of the electrical contacts, the ferrite block having two slots extending through the block, each slot having a height less than a width of the slot, and a height of the ferrite block being less than a width of the ferrite block.

14. An electrical connector as in claim 13 wherein the slots have cross-sectionally rectangular shapes along a length of the block.

15. An electrical connector as in claim 13 wherein the contacts each have two connection areas at opposite ends of the contacts and the ferrite block is located between and spaced from the two connection areas.

16. An electrical connector as in claim 13 wherein the portions of the electrical contacts have flat cross-sectional rectangular shapes.

17. An electrical connector as in claim 13 wherein the electrical contacts each comprise a portion having a general hump shape forming a space for receiving an end of the first female connection area, wherein the end of the first female connection area extends upward past a bottom of the ferrite block.

18. An electrical connector as in claim 13 wherein the electrical contacts each comprise a lead between first and second connection areas, and wherein the portions surrounded by the ferrite block comprise a majority of a length of the leads.

* * * * *